United States Patent [19]

Löfkvist

[11] Patent Number: 4,972,681

[45] Date of Patent: Nov. 27, 1990

[54] FREEZING DEVICE

[75] Inventor: Christer Löfkvist, Helsingborg, Sweden

[73] Assignee: Frigoscandia Contracting AB, Helsingborg, Sweden

[21] Appl. No.: 460,881

[22] PCT Filed: Aug. 2, 1988

[86] PCT No.: PCT/SE88/00392

§ 371 Date: Feb. 6, 1990

§ 102(e) Date: Feb. 6, 1990

[87] PCT Pub. No.: WO89/01121

PCT Pub. Date: Feb. 9, 1989

[30] Foreign Application Priority Data

Aug. 6, 1987 [SE] Sweden ..... 8703065-6

[51] Int. Cl.[5] ..... F25D 25/04

[52] U.S. Cl. ..... 62/374; 62/63; 62/380

[58] Field of Search ..... 62/63, 374, 380

[56] References Cited

U.S. PATENT DOCUMENTS

| | | | |
|---|---|---|---|
| 3,277,657 | 10/1966 | Harper et al. | 62/63 |
| 3,345,828 | 6/1965 | Klee et al. | 62/63 |
| 3,485,055 | 9/1964 | Webster et al. | 62/63 |
| 3,507,128 | 12/1967 | Murphy et al. | 62/63 |
| 3,609,987 | 10/1971 | Waldin | 62/63 |
| 3,831,389 | 8/1974 | Lipona | 62/63 |
| 4,265,096 | 5/1981 | Andersson | 62/380 |
| 4,281,521 | 8/1981 | Martin et al. | 62/380 |
| 4,403,479 | 9/1983 | Rasovich | 62/63 |
| 4,448,029 | 5/1984 | Keller | 62/63 |
| 4,517,814 | 5/1985 | Rothstein | 62/374 |
| 4,627,244 | 12/1986 | Willhoft | 62/374 |

FOREIGN PATENT DOCUMENTS 0084683 12/1982 Hague .

*Primary Examiner*—Ronald C. Capossela

*Attorney, Agent, or Firm*—Browdy and Neimark

[57] ABSTRACT

A freezing device having a substantially closed container is shown and described. The top part of the container has a feed opening and a discharge opening. These openings are located above a maximum level of cooling medium in a container, which cooling medium in a gaseous stage is heavier than air. A first tube extends through an additional opening in the top side of the container and forms an overflow. By means of this device, the level of the cooling medium is maintained constant in the container and excess cooling medium is removed by means of a second tube and pipe connected to it.

7 Claims, 4 Drawing Sheets

FREEZING DEVICE

The present invention generally relates to a freezing device for freezing products, such as foodstuffs, which freezing device is designed as a substantially closed container having a top side provided with a feed opening and a discharge opening, and particularly to a new device for maintaining constant the level of a cooling medium in such a container.

It is known to design a freezing device as a substantially closed container in order to enclose a cooling medium in the container.

EP No. -A3-0,084,683, for example, discloses a freezing device which is designed as a substantially closed container having a feed opening and a discharge opening, in which container a cooling medium is enclosed if conveyors provided in the container maintain a certain feed rate, such that the product flow counteracts the flow of cooling medium, whereby equilibrium is achieved and the cooling medium is enclosed in the container.

U.S. Pat. No. 3,485,055 and U.S. Pat. No. 3,774,524 also disclose devices which are designed as substantially closed containers, the latter reference in particular illustrating in one embodiment product infeed and outfeed through a water bath, thus preventing a gaseous cooling medium from escaping from the container.

Enclosing a cooling medium in a container which is provided with openings and also charged with products to be frozen, in which case the cooling medium is evaporated and thus is more liable to escape from the container, and maintaining the cooling medium on a constant level thus are problems which are difficult to solve in an appropriate way.

U.S. Pat. No. 4,448,029, for example, discloses a device for removing excess cooling medium formed when freezing various products, such as foodstuffs, in which device a pipe system is connected to a fan continuously sucking a mixture of air and gaseous cooling medium out of the freezer.

The said container and suction devices however suffer from a number of serious drawbacks. In many devices, there is a very substantial risk of leakage of cooling medium through the feed and/or the discharge opening. The cooling medium, most often being liquid nitrogen, evaporates and produces nitrogen gas which, in connection with functional trouble or upon a rapid increase of the amount of nitrogen gas, may escape from the freezing device, the leaking nitrogen gas cooling the ambient air and, at worst, may reduce the oxygen content of the air in the working premises to a critical limit.

A further drawback inherent in the prior art technique when sucking off the excess nitrogen gas formed during the freezing of different products is that the removal of the gas by suction creates a depression within the freezer. This depression is equalized by relatively warm ambient air being sucked through openings into the freezer where it gives rise to increased production of nitrogen gas. This phenomenon reduces the efficiency of the freezer since part of the nitrogen takes up the heat from the air and not from the products to be frozen.

The drawback of letting the products pass a water bath separating the interior of the freezer from the surroundings is, for instance, that the products must be resistant to moisture, which is quite inconvenient, inter alia in respect of food technology requirements, hygiene and appearance.

One object of the present invention therefore is to provide a device for maintaining constant the level of a cooling medium in a freezing device.

Another object of the present invention is to enhance the degree of utilization of the freezing device and to protect the environment proximate to the freezing device from undesired emissions of cooling medium from the freezing device.

Also, the new device for maintaining the cooling medium on a constant level should be of simple construction, it should not restrict the field of use of the freezing device, and it should be inexpensive to manufacture.

These and other objects of the invention are achieved by means of a freezing device using a cooling medium which takes up heat during the freezing process and which then at least partly changes its state to gaseous state, which device is designed as a substantially closed container having a top side provided with a feed and a discharge opening, which freezing device is characterized according to the invention in that the feed and discharge openings are located above a maximum level of the gaseous part of the cooling medium in the container, which cooling medium when in the gaseous state is heavier than air, that a first tube extends through a further opening in the top side of the container and forms an overflow, whereby the level of the cooling medium in the freezing device is maintained constant and excess cooling medium is discharged via the overflow.

Other improvements and embodiments of the freezing device recited in the main claim are achieved by the features stated in the subclaims.

The device according to the invention having the features recited in the characterizing clause of the main claim provides a cost-effective device which maintains the level of the cooling medium constant and discharges upwardly flowing excess cooling medium without any build-up of a depression in the freezing device.

An example of a freezing device according to the invention will be described in more detail hereinbelow with reference to the accompanying drawings.

Figure 1:
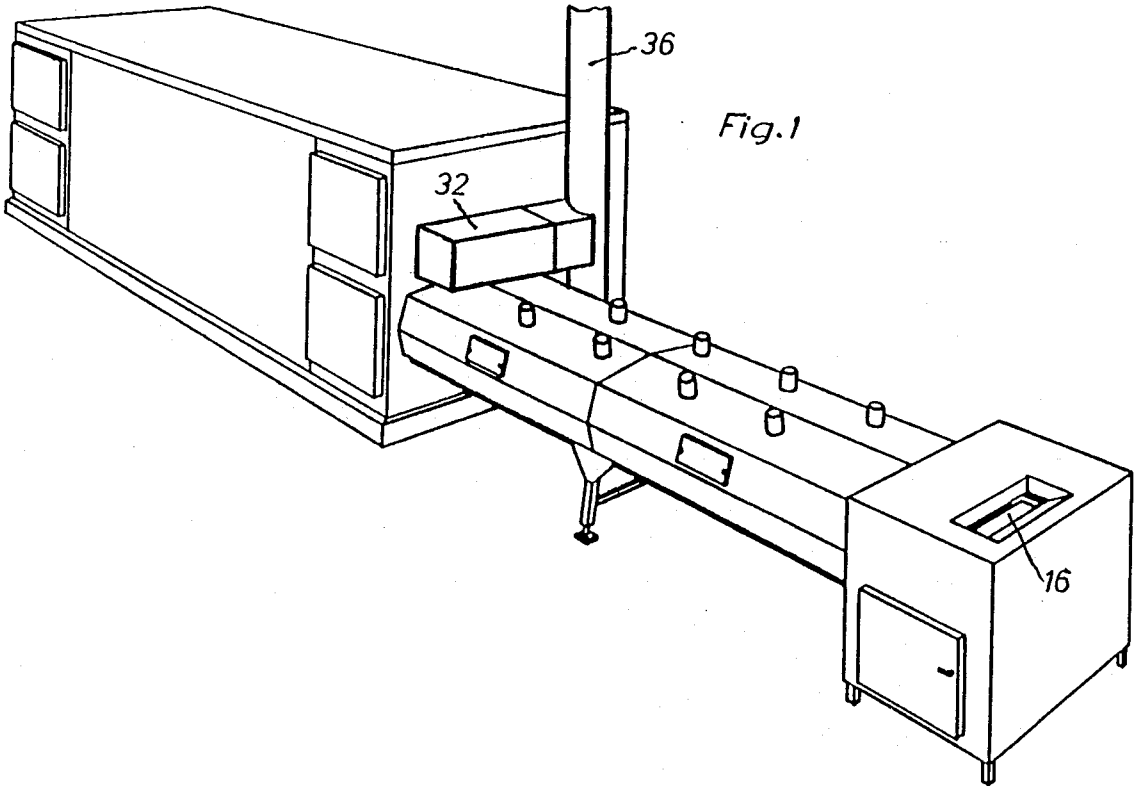
FIG. 1 is a perspective view of a freezing device according to the invention.
Figure 2:
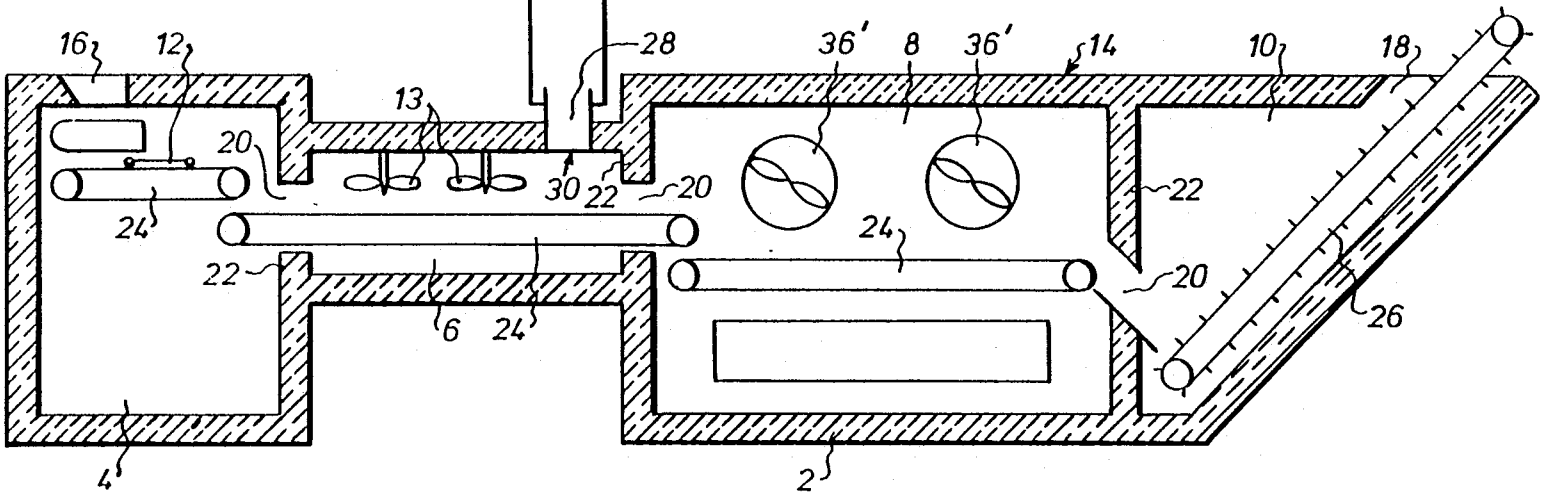
FIG. 2 is a schematic side view of the freezing device in FIG. 1.

FIGS. 1 and 2 show an inventive freezing device comprising an insulating casing 2 which forms a container having a first space 4, a second space 6, a third space 8, and a fourth space 10. The first space 4 accommodates means 12 which is arranged for treating a product with a liquid cooling medium and which may consist of means as used in U.S. Pat. No. 4,517,814. The cooling medium used advantageously is liquid nitrogen ($N_2$). The second space 6 houses a plurality of fans 13 for circulating the gas present in the second space 6.

The first and second spaces 4, 6 form a first freezing unit, and the third space 8 forms a second freezing unit, while the fourth space 10 forms a discharge space. In a preferred embodiment of the present invention, the first freezing unit is a nitrogen freezer, and the second freezing unit is an air freezer.

The container has a top side 14 provided with openings. A feed opening 16 is provided above the first space 4, and a discharge opening 18 is provided above the fourth space 10. A plurality of belt conveyors 24 extend up to and/or through openings 20 in partitions 22 separating the different spaces. For discharging frozen products (not shown), there is provided in the fourth space 10 a discharge conveyor 26 which extends upwards through the discharge opening 18 and out of the freezing device.

In the opening 20 in the partition between the second and the third space 6, 8, there is provided a gas seal (not shown) which in the preferred embodiment of the present invention consists of air coming from the air freezer and circulating at the wall opening 20. The gas seal may however consist of any other type of blocking means, as long as it allows the products to pass through on their, way into the third space 8.

A first tube 28 extends through a further opening 30 provided in the top side 14 above the second space 6. The first tube 28 extends into a second tube 32 in which the first tube 28 forms an overflow.

Figure 3:
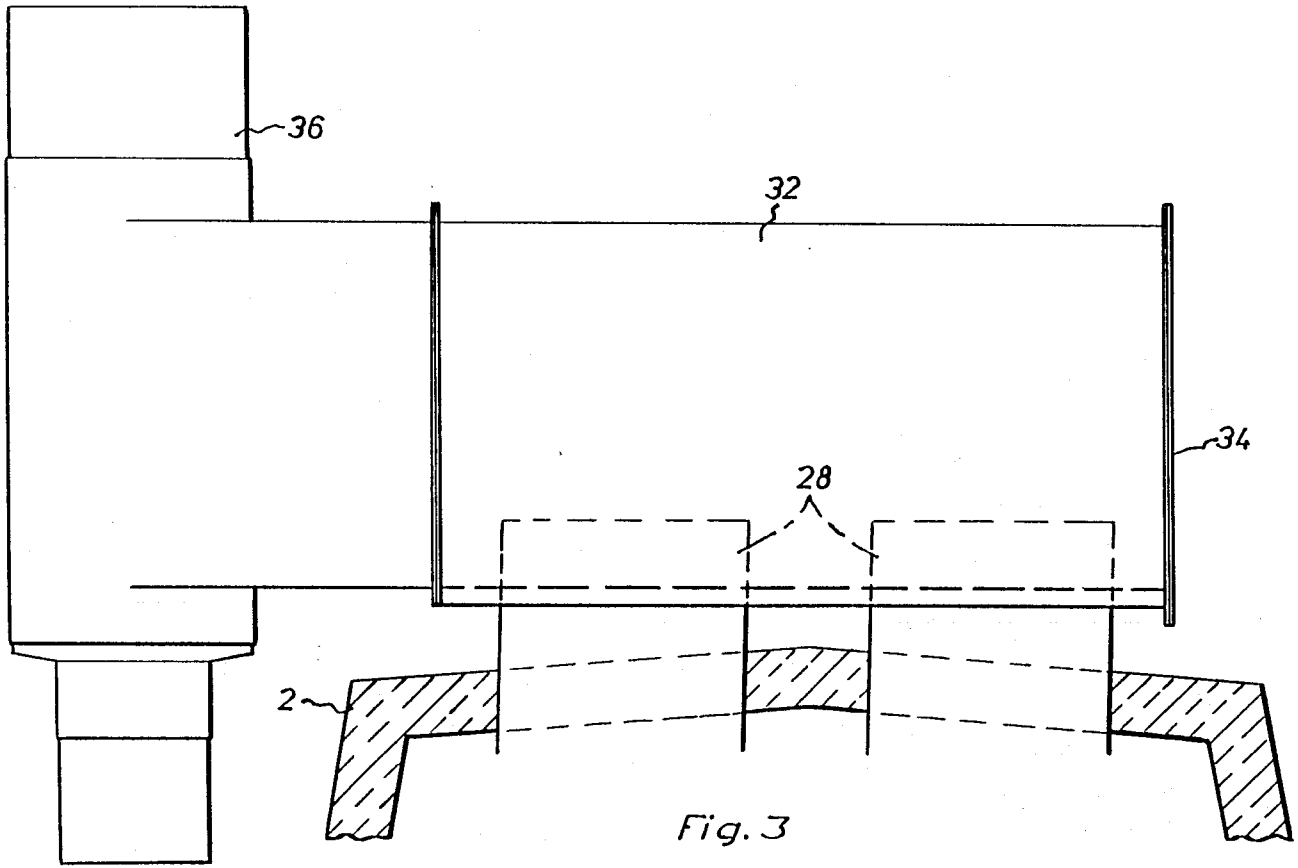
FIG. 3 is an enlarged front view of a device, shown in FIG. 1, for maintaining the cooling medium level constant.

As appears particularly from FIG. 3, the second tube 32 is substantially horizontal. The second tube 32 has an open end 34. The end of the second tube 32 opposite the open end 34 thereof connects the tube 32 to a pipe 36. In one end of the pipe 36, fan means (not shown) are provided.

Figure 4:
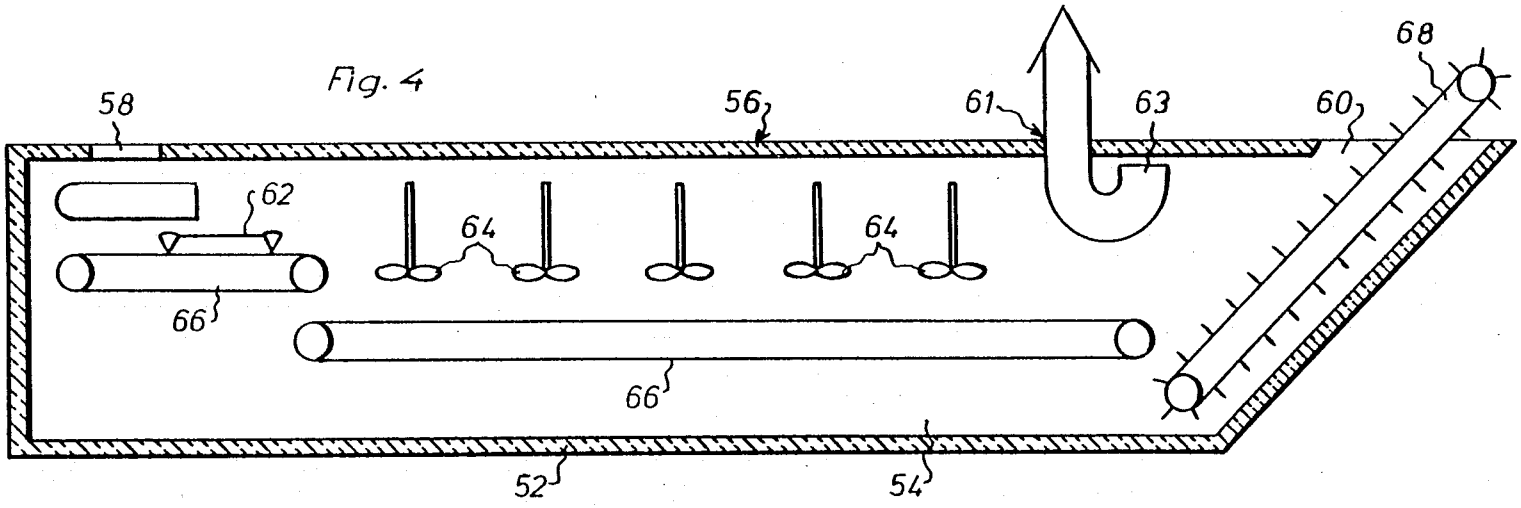
FIG. 4 is a schematic side view of another embodiment according to the invention.

FIG. 4 illustrates another embodiment of a freezing device according to the invention which comprises an insulating casing 52 forming a container with a single space 54. The container has a top side 56 provided with openings. At one end of the top side 56, there is provided a feed opening 58. At the other end of the top side 56, there is provided a discharge opening 60. Also, the top side 56 is provided with a further opening 61. Through the further opening 61 extends a pipe 63 forming an overflow. In the immediate vicinity of the feed opening 58, inside the container, there is provided means 62 for treating a product with a liquid cooling medium. Additionally, there are provided a plurality of fans 64 in the space 54 as well as a plurality of conveyors 66, and a discharge conveyor 68 which extends upwards through the discharge opening 60 and out of the freezing device.

Products to be frozen are conveyed in any suitable manner to the feed opening 16 provided in the top side 14 of the freezing device shown in FIGS. 1–3. The products are dropped onto the conveyor 24 in the container. The products pass the means 12 which is arranged to treat the products with liquid nitrogen ($N_2$) The products are thereafter transferred onto a first one of the conveyors 24 feeding the products into the second space 6. By means of the fans 13 provided in the second space 6, the surface of the products is frozen in a uniform manner, and the products leave the second space 6 and are conveyed into the third space 8 which in a preferred embodiment of the present invention is a conventional air freezer. Within the third space 8, the products are deep-frozen and thereafter transferred onto the discharge conveyor 26 having one end located at the bottom of the fourth space 10 and conveying the products upwards through the discharge opening 18 and out of the freezing device to a receiving station (not shown). The outfeed is performed at the same feed rate as that of the other conveyors 24.

In the treatment of the products with liquid nitrogen ($N_2$), the heat of the products is taken up by the liquid nitrogen, which starts to boil and produce nitrogen gas. The nitrogen gas is heavier than air and deposits on the bottom of the freezing device. The fans 13 in the second space 6 are arranged to produce whirls setting the nitrogen gas on the bottom of the second space 6 in motion. In this manner, the nitrogen gas is better distributed in the second space 6, whereby the degree of utilization of the freezing device is increased. The nitrogen gas is retained substantially in the first and the second space 4, 6 by a gas seal (not shown) provided at the opening 20 in the partition 22 between the second and third spaces 6, 8. In the preferred embodiment of the present invention, this gas seal consists of air, the second freezing unit being an air freezer. Fans 36' produce an air flow transversely of the direction of travel of the products. This air flow practically completely blocks the opening 20 in the partition 22 between the second and the third space 6, 8. The products can of course pass this air flow, but the nitrogen gas is prevented from entering into the third and fourth spaces 8, 10. It is evident that the gas seal may consist of any type of blocking element allowing the products to pass on their way to the fourth space 10.

As the treatment of the products proceeds, and hence the production of nitrogen gas, there is an increased need to remove the nitrogen gas formed. To this end, the first tube 28 extends through the additional opening 30 in the top side 14, above the second space 6, and adjacent the partition 22 between the second and the third space 6, 8. The tube 28 extends into the second tube 32, such that the top end of the first tube 28 is located on the same level as or on a lower level than the desired maximum level of the nitrogen gas in the freezing device. In this manner, the nitrogen gas, like a water column, will also rise in the first tube 28. Before or as the nitrogen gas reaches the maximum permissible level, it will "flow over" the rim of the top end of the first tube 28 and into the second tube 32. The second tube 32 is open at one end 34, while its other end connects the tube 32 to the pipe 36. At some point along the pipe 36, fan means (not shown) are provided for producing an air flow through the pipe 36. When the air flow passes the opening into the second tube 32, a feeble air flow is produced from the open end 34 of the second tube 32, which air flow sweeps over the top end of the first tube 28, thereby entraining all rising excess nitrogen gas into the pipe 36.

The advantages gained by the present invention can be summed up as follows.

(1) Designing the freezing device as a substantially closed container with a top side 14 provided with openings makes it possible to arrange the tube 28, designed as an overflow, for maintaining constant the level of a cooling medium in the container.

(2) The separate pipe 36, through which air flows, and the open end 34 of the second tube that is arranged to equalize pressure differences in the pipe system, make efficient removal of rising nitrogen gas possible without any build-up of a depression in the freezer, such that the nitrogen gas is maintained at an upper maximum level, to ensure efficient utilization of the freezer.

(3) Finally, the device is of simple construction.

It is evident that any modifications and variants of the present invention, such as the variant shown in FIG. 4, are possible within the spirit and scope of the accompanying claims.

I claim:

1. A freezing device comprising in combinations:

a heavier than air gaseous cooling medium which takes up heat during the freezing process and which then at least partially changes its state to a gaseous state;

a substantially closed container having a top side provided with a feed and a discharge opening;

wherein the feed and discharge openings are located above a maximum level of the gaseous cooling medium in the container;

a first tube extending through an opening in the top side of the container and forming an overflow, whereby the level of the cooling medium in the freezing device is maintained constant and excess cooling medium is removed via said overflow;

a substantially horizontal second tube into which said first tube opens, having a first open end and a second end;

a pipe connected to said second end having fan means for producing an air flow through said pipe; and wherein air flows from the open end of the second tube, over the opening of the first tube and into the pipe, thus ensuring the removal of rising gas.

2. Device as claimed in claim 1 further comprising a first, a second and a third space in the container, said first and said second spaces forming a first freezing unit, and said third space (8) forming a second freezing unit.

3. Device as claimed in claim 2, wherein said further opening is provided in the top side of the container above said second space.

4. Device as claimed in claim 2, wherein the second freezing unit forms a gas seal between the second and the third space (6, 8).

5. Device as claimed in claim 1, wherein the cooling medium in the first freezing unit is nitrogen, $N_2$, and that the second freezing unit is a conventional air freezer 6. Device as claimed in claim 1, a plurality of conveyors provided in the freezing device for conveying products to be frozen, from a feed station through said three spaces and through a discharge space and a discharge conveyor through the discharge opening (18) and conveying frozen product out of the freezing device.

7. Device as claimed in claim 6, wherein the belt conveyors and the discharge conveyor travel at substantially the same feed rate.

* * * * *